US007237563B2

(12) United States Patent
Han et al.

(10) Patent No.: US 7,237,563 B2
(45) Date of Patent: Jul. 3, 2007

(54) DISH WASHER AND DEVICE FOR CONTROLLING WASHING WATER FLOW PASSAGE THEREIN

(75) Inventors: Dae Yeong Han, Seoul (KR); Nung Seo Park, Inchonkwangyok-shi (KR); Sang Heon Yoon, Seoul (KR); Si Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 553 days.

(21) Appl. No.: 10/406,196

(22) Filed: Apr. 4, 2003

(65) Prior Publication Data

US 2004/0112412 A1 Jun. 17, 2004

(30) Foreign Application Priority Data

Dec. 11, 2002 (KR) ..... 10-2002-0078813

(51) Int. Cl.
*B08B 3/00* (2006.01)

(52) U.S. Cl. ..... 134/58 D; 134/110; 134/186

(58) Field of Classification Search ..... 134/56 D, 134/57 D, 58 D, 110, 184, 186, 200
See application file for complete search history.

(56) References Cited

U.S. PATENT DOCUMENTS 2,918,927 A * 12/1959 Clearman ..... 134/200
3,797,509 A * 3/1974 Fukuzawa et al. ..... 134/178
3,868,835 A * 3/1975 Todd-Reeve ..... 68/20

(Continued)

FOREIGN PATENT DOCUMENTS

CN 87207753 3/1988

(Continued)

OTHER PUBLICATIONS

Electronic english translation of EP 1046369.*

(Continued)

*Primary Examiner*—Joseph L. Perrin
(74) *Attorney, Agent, or Firm*—Greenblum & Bernstein, P.L.C.

(57) ABSTRACT

Device for controlling a washing water flow passage in a dish water for controlling the washing water supplied to arms for spraying washing water to dishes. The device for controlling a washing water flow passage includes an inlet tube, first, second, third, and fourth tubes, first and second outlet tubes, a ball, a ball seat, and a valve. The first tube is extended upward from the inlet tube, and the second tube is extended slanted upward from the inlet tube. The third tube is extended upward vertically from a top of the second tube, and the fourth tube is connected between the first tube and the third tube in a downward slanted direction. The first outlet tube is formed on a top of a part where the first tube and the fourth tube are joined, and the second outlet tube is formed on a top of the third tube. The ball seat is provided to an inside of the inlet tube, and the valve is provided to one side of the first tube for blocking pass of the ball. The ball controls the flow passage of the washing water supplied to arms that sprays the washing water as the ball moves in the first, second, third, or fourth tube by a washing water pressure and gravity and opens/closes the first or second outlet tube selectively.

12 Claims, 4 Drawing Sheets

U.S. PATENT DOCUMENTS

| | | | | |
|---|---|---|---|---|
| 4,741,353 | A | 5/1988 | Milocco | |
| 5,264,043 | A * | 11/1993 | Milocco | 134/25.2 |
| 5,566,696 | A * | 10/1996 | Dries et al. | 134/104.1 |
| 5,899,433 | A * | 5/1999 | Kim et al. | 251/30.01 |
| 6,705,330 | B1 * | 3/2004 | Favret | 134/56 D |

FOREIGN PATENT DOCUMENTS

| | | |
|---|---|---|
| CN | 2356638 | 1/2000 |
| EP | 1046369 | 10/2000 |
| EP | 1088509 | 4/2001 |
| EP | 1183986 | 3/2002 |
| EP | 1183987 | 3/2002 |
| FR | 2789451 | 8/2000 |
| JP | 09327432 A * | 12/1997 |
| JP | 2001-321316 | 11/2001 |
| WO | 01/03568 | 1/2001 |
| WO | WO 0182769 A1 * | 11/2001 |

OTHER PUBLICATIONS

English language Abstract of JP 2001-321316.

* cited by examiner

DISH WASHER AND DEVICE FOR CONTROLLING WASHING WATER FLOW PASSAGE THEREIN

This application claims the benefit of the Korean Application No. P2002-0078813 filed on Dec. 11, 2002, which is hereby incorporated by reference.

BACKGROUND OF THE INVENTION

1. Field of the Invention

The present invention relates to dish washers, and more particularly, to a dish washer can wash dishes with either an upper rack or lower rack inside of a wash chamber, and a device for controlling a washing water flow passage which makes the same available.

2. Background of the Related Art

The dish washer is an appliance in which detergent and washing water is sprayed onto dishes for automatic washing and drying the dish. FIG. 1 illustrates a related art dish washer.

Referring to FIG. 1, the related art dish washer is provided with a cabinet 1, a washing chamber 3, a plurality of racks 4 and 5, a cleaning filter 6, a sump 7, a pump 8, a plurality of arms 10 and 11, and a drain pump 12.

The cabinet 1 is an outside case of the dish washer. The cabinet 1 has a door 2 in one side, and the washing chamber 3 is provided to an inside of the cabinet 1.

The plurality of racks 4 and 5, for an example, an upper rack 4 and a lower rack 5 are provided to an inside of the washing chamber 3 for placing the dishes thereon. The cleaning filter 6 filters washing water from outside of the cabinet 1, the filtered washing water is gathered in the sump 7 and stored therein temporarily.

The pump 8 is, for an example, a centrifugal pump, for drawing the washing water from the sump 7 through a washing water inlet 8*a* and pumping out through a first outlet 8*b* and a second outlet 8*c*, respectively. The first outlet 8*b* and the second outlet 8*c* are connected to water passages that are lead to different parts of an inside of the washing chamber 3, such as the upper part and a lower part thereof. The water passage may be a connection pipe 9 connected between the upper part of the washing chamber 3 and the first outlet 8*b*.

The plurality of arms 10 and 11, for an example, an upper arm 10 and a lower arm 11, are provided in the vicinity of racks 4 and 5 inside of the washing chamber 3. The arms 10 and 11 are rotatably connected to the connection pipe 9 and the second outlet 8*c* respectively, for being rotated and spraying water toward dishes on the racks 4 and 5. The drain pump 12 is provided for pumping the water, sprayed from the arms 10 and 11 and fallen down to a bottom of the washing chamber 3, to an outside of the dish water.

The foregoing related art dish washer washes the dishes by the following process.

Upon putting the dish washer into operation after placing the dishes on the racks 10 and 11 in the washing chamber 3 and closing the door 2, the washing water in the sump 7 is pumped as the pump 8 comes into operation. Of course, the washing water in the sump 7 is supplied from outside of the dish washer and filtered through the cleaning filter 6.

The washing water pumped by the pump 8 is discharged through the first outlet 8*b* and the second outlet 8*c*, wherein the washing water discharged to the first outlet 8*b* is supplied to the upper arm 10 via the connection pipe 9. The upper arm 10 is rotated, and sprays washing water, for washing the dishes on the upper rack 4.

On the other hand, the washing water, pumped by the pump 8 and discharged through the second outlet 8*c*, is supplied to the lower arm 11. The lower arm 11 is rotated and sprays washing water for washing the dishes on the lower rack 5.

The washing water having cleaned the dishes thus by above process falls down to a lower part of the washing chamber 3, and the drain pump 12 discharges the washing water to an exterior.

Of course, though the dish washer is provided with various sterilizing and drying devices for carrying out sterilizing and drying required after the washing, detailed description of which will be omitted.

In the meantime, the related art dish washer discharges the washing water pumped by the pump 8 to the first outlet 8*b* and the second outlet 8*c*, such that both the upper arm 10 and the lower arm 11 spray the washing water, simultaneously. However, such a structure has a problem in that much washing water is consumed unnecessarily even if the dishes are placed either on the upper rack 4 or on the lower rack 5 in the washing because there are a small amount of dishes to be washed.

Consequently, demands for a dish washer rises, which can wash the dishes on either the upper rack 4 or the lower rack 5, when the amount of dishes to be washed is small.

SUMMARY OF THE INVENTION

Accordingly, the present invention is directed to a dish washer, and a device for controlling a washing water flow passage that substantially obviates one or more of the problems due to limitations and disadvantages of the related art.

An object of the present invention is to provide a dish washer which can wash dishes with either an upper rack or lower rack.

Another object of the present invention is to provide a simple device for controlling a washing water flow passage, which can control washing water flow passages to arms, so that the washing can be carried out with either the upper rack or the lower rack in a dish washer.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the dish washer includes a cabinet having a door in one side thereof, a washing chamber provided to an inside of the cabinet, a device for supplying washing water for filtering the washing water supplied from an outside of the cabinet and pumping the washing water, a piping for guiding the washing water pumped by the device for supplying washing water to the washing chamber, a plurality of arms for spraying the washing water supplied into the washing chamber by guidance of the piping to wash the dishes, and a device for controlling a washing water flow passage in the middle of the piping, for controlling a flow passage of the washing water with a ball moving by water pressure and gravity, to supply the washing water to one of the arms selectively, or to all of the arms.

The device for supplying washing water includes a cleaning filter for filtering the washing water supplied to the cabinet, a sump for storing the washing water filtered at the cleaning filter, and a pump for pumping the washing water from the sump.

The piping includes a supply pipe for receiving the washing water pumped at the device for supplying the washing water, and branch pipes branched from the supply pipe to the arms, respectively.

The device for controlling a washing water flow passage is provided to a part the supply pipe and the branch pipes join.

In another aspect of the present invention, there is provided a device for controlling a washing water flow passage in a dish washer including an inlet tube connected to the supply pipe for receiving filtered and pumped washing water, a first tube extended upward from the inlet tube, a second tube extended slanted upward from the inlet tube, a third tube extended upward from a top of the second tube, a fourth tube connected between the first tube and the third tube in a downward slanted direction, a first outlet tube formed on a top of a part where the first tube and the fourth tube are joined, and connected to one of the branch pipes, a second outlet tube formed on a top of the third tube, and in communication with a second arm connected to the other one of the branch pipes, a ball moving in the first, second, third, or fourth tube by a washing water pressure and gravity, and opening/closing the first or second outlet tube selectively, a ball seat provided to an inside of the inlet tube for seating the ball, and a valve provided to one side of the first tube for selectively blocking pass of the ball.

The ball seat is formed of a net, or is a projection from an inside surface of the inlet tube for supporting the ball.

The ball is formed of rubber, only a surface thereof, or entirely.

The first and second outlet tube has a diameter smaller than a diameter of the ball.

The first outlet tube has an axis passing through an outside of the first tube.

The device for controlling a washing water flow passage may further includes a sloped guide surface at a part the top of the first tube and bottom of the first outlet tube join.

The valve includes a valve body provided to an outside surface of the first tube having an inside thereof in communication with an inside of the first tube, and a bar provided to an inside of the valve body for being projected across the inside of the first tube to block pass of the ball.

The bar includes a fore end for blocking a part of an inside of the second tube to block pass of the ball between the second tube and the inlet tube when the bar is projected from the valve body.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, parts of the present invention identical to the related art will be given the same names and reference symbols.

Figure 1:
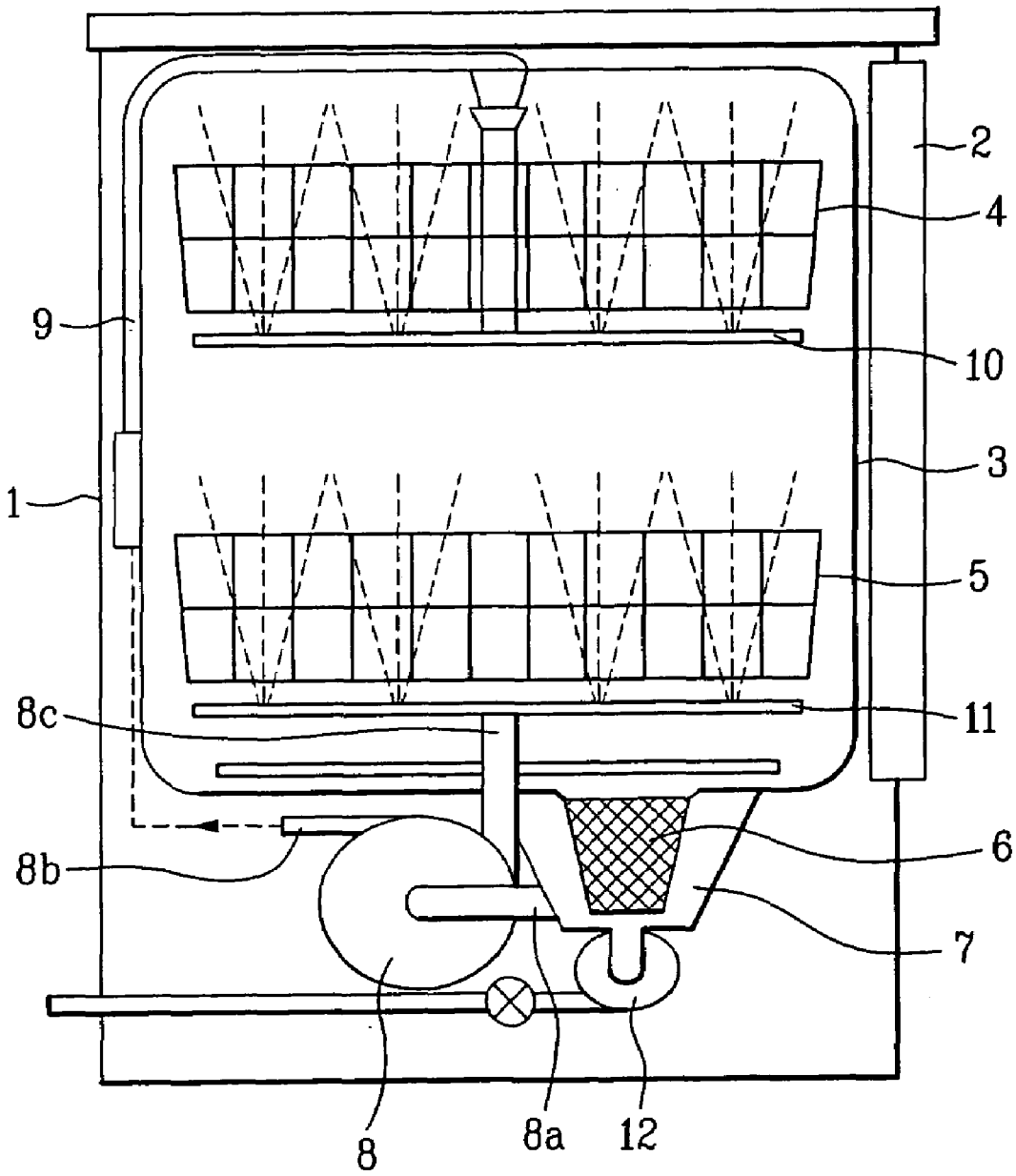
FIG.1 Prior Art
FIG. 1 illustrates a structure of a related art dish washer.
Figure 2:
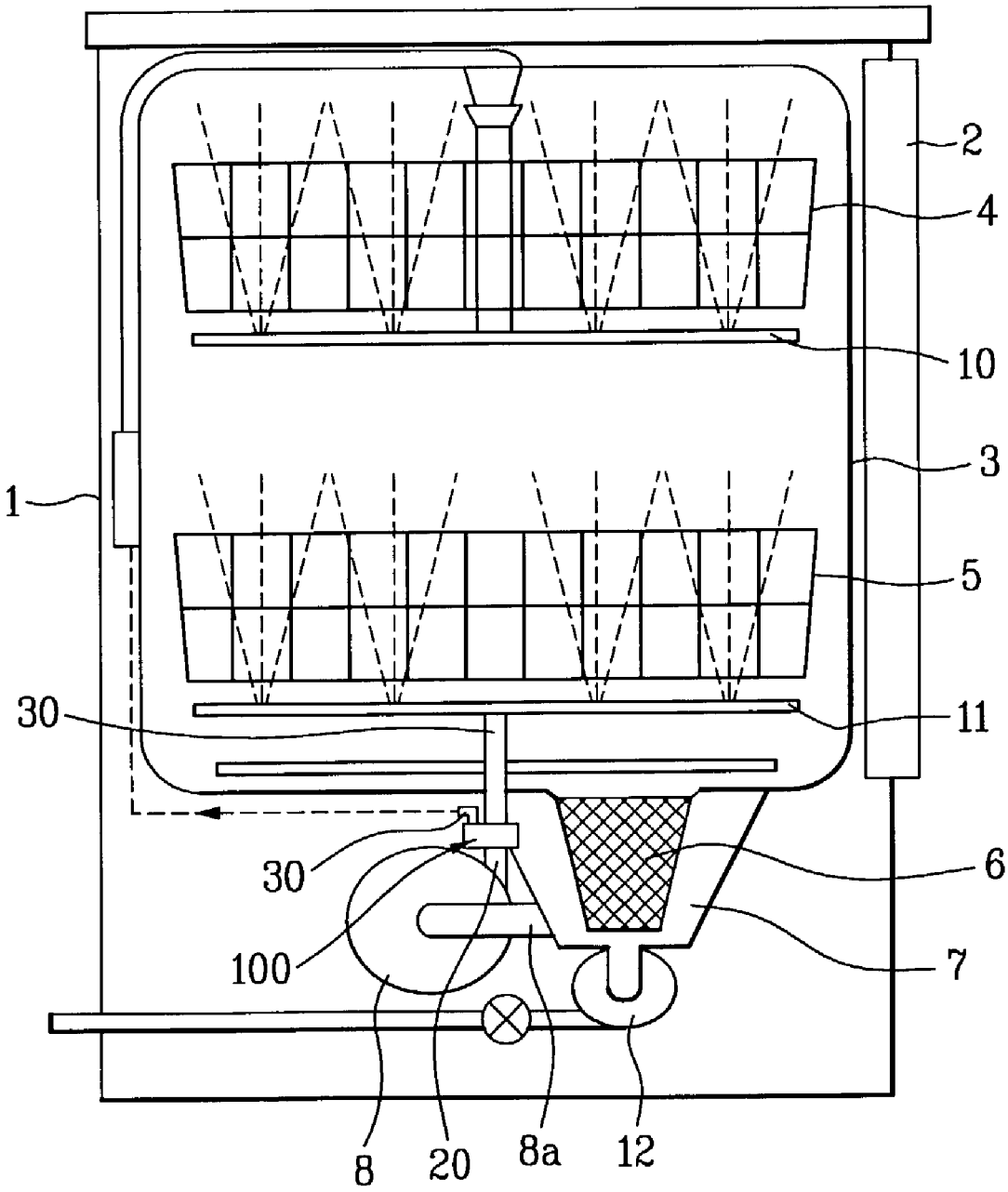
FIG. 2 illustrates a structure of a dish washer of the present invention.

FIG. 2 illustrates a structure of a dish washer of the present invention.

Referring to FIG. 2, the dish washer of the present invention includes a cabinet 1, a washing chamber 3, a device for supplying washing water, piping, a plurality of arms 10 and 11, and a device 100 for controlling a washing water passage.

The cabinet 1 is an outside case of the dish washer. The cabinet 1 has a door 2 in one side. The washing chamber 3 is provided to an inside of the cabinet 1. The plurality of racks 4 and 5, for an example, an upper rack 4 and a lower rack 5 are provided to an inside of the washing chamber 3.

The device for supplying washing water, provided for filtering the washing water supplied from an outside of the cabinet 1, includes a pump 8, a sump 7, and a cleaning filter 6. The washing water supplied from the outside of the cabinet 1 is filtered through the cleaning filter 6, and stored in the sump 7, temporarily. The washing water stored in the sump 7 is drawn into the pump 8 through an inlet 8*a* and discharged through an outlet. The pump 8 for pumping the washing water is a centrifugal pump.

The piping, provided for guiding the washing water pumped by the device for supplying washing water to the washing chamber 3, includes a supply pipe and a branch pipe 30.

The supply pipe 20 connects an outlet of the pump 8 to the device 100 for controlling a washing water flow passage, for receiving the washing water pumped from the device for supplying washing water to the device 100 for controlling a washing water flow passage.

There are a plurality of, for an example, two, branch pipes 30 for connecting the device 100 for controlling a washing water flow passage to the arms 10 and 11. Proper connection positions of the arms 10 and 11 to the device 100 for controlling a washing water flow passage will be described together with the device 100 for controlling a washing water flow passage.

The arms 10 and 11 are provided in the vicinity of racks 4 and 5 inside of the washing chamber 3. As shown in FIG. 2, the arms 10 and 11 may be, for an example, a first arm 10 in the vicinity of the upper rack 4, and a second arm 11 in the vicinity of the lower rack 5, for being rotated and spraying the washing water supplied by guidance of the piping to wash the dishes on the racks 4 and 5.

The dish washer further includes the drain pump 12 for pumping the washing water, fallen down to a bottom of the washing chamber 3 after washing, to an exterior.

As described before, the device 100 for controlling a washing water flow passage is provided to a branch point in the middle of the piping, specifically at a branch point where the supply pipe 20 and the branch pipe 30 branch, for controlling a flow passage of the washing water with a ball 190, moving by water pressure and gravity, to supply the washing water to one of the arms 10 and 11 selectively, or to all of the arms 10 and 11. One embodiment of the device 100 for controlling a washing water flow passage is shown well in FIG. 3.

Figure 3:
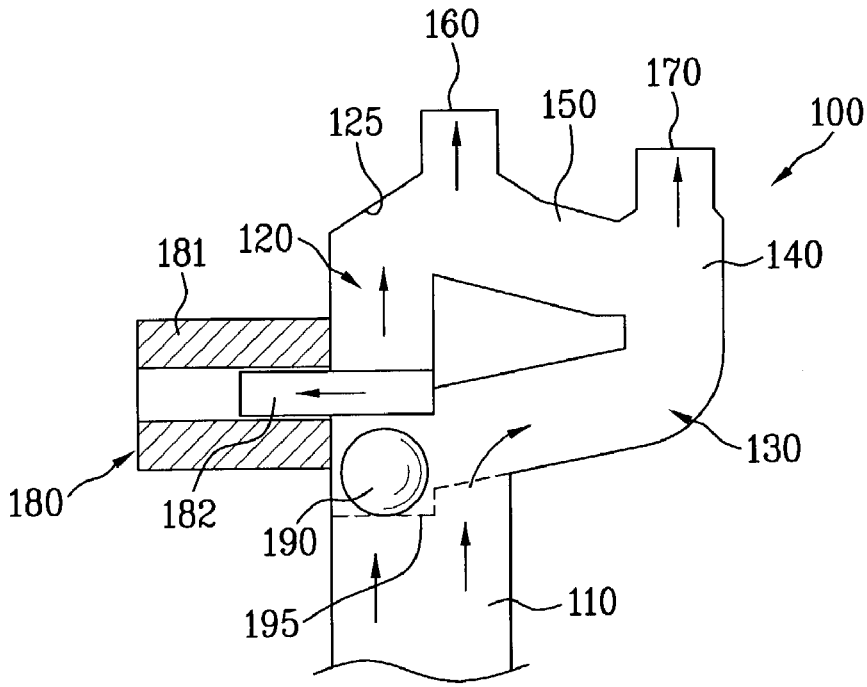
FIG. 3 illustrates a device for controlling a washing water flow passage in accordance with a preferred embodiment of the present invention.

Referring to FIG. 3, the device 100 for controlling a washing water flow passage of the present invention includes an inlet tube 110, a first tube 120, a second tube 130, a third tube 140, a fourth tube 150, a first outlet tube 160, a second outlet tube 170, a ball 190, a ball seat 195, and a valve 180.

The inlet tube 110 is connected to the supply pipe 20, for receiving the washing water. The first tube 120 is extended upward from a top of the inlet tube 110, for an example, in a vertical direction. The second tube 130 is extended slanted upward from the top of the inlet tube 110. The first and second tube 120 and 130 has a diameter smaller than a diameter of the inlet tube 110. The third tube 140 is extended upward, for an example, in a vertical direction, from a top of the second tube 130. The fourth tube 150 connects the first tube 120 to the third tube 140 in a downward slanted direction. Thus, the first, second, third, and fourth tubes 120, 130, 140, and 150 form one loop for moving the ball 190 around.

The first outlet tube 160 is connected to a top of a part where the first tube 120 and the fourth tube 150 are joined, so that the first outlet tube 160 is made to be in communication with one of the arms 10 and 11 which spray the washing water in the washing chamber 3 by being connected to one of the branch tubes 30. As shown in FIG. 3, the first outlet tube 160 is positioned such that an axis thereof passes an outside of the first tube 120.

The second outlet tube 170 is connected to a top of the third tube 140, for an example, in a vertical direction, so that the second outlet tube 170 is made to be in communication with the other one of the arms 10 and 11 which spray the washing water in the washing chamber 3, for an example, the second arm 11, by being connected to the other one of the branch tubes 30.

The ball 190 is formed of rubber, only a surface thereof or entirely. The ball moves in the first, second, third, or fourth tubes 120, 130, 140, or 150 by a pressure of the pumped washing water and gravity. And the ball opens or closes the first or second outlet tube 160 or 170 selectively. For this, it is required that a diameter of the first, second, third, or fourth tube 120, 130, 140, or 150 is formed greater than a diameter of the ball 190, and a diameter of the first and second outlet tube 160 and 170 is smaller than the diameter of the ball 190.

The ball seat 195 is provided to an inside of the inlet tube 110, so that the ball 190 seats and supported thereon to prevent the ball 190 from falling down from the inlet tube 110. The ball seat 195 may be a net formed such that the washing water makes easy pass while pass of the ball 190 is blocked, or a projection (not shown) projected from an inside surface of the inlet tube 110, so as to support the ball 190 to prevent the ball 190 from falling down.

The valve 180 is provided to one side of the first tube 120, for selectively blocking pass of the ball 190. The valve 180 may include a valve body 181 and a bar 182.

Referring to FIG. 3, the valve body 181 is provided to an outside surface of the first tube 120, with an inside thereof in communication with an inside of the first tube 120. For this, the first tube 120 has an opening in a side having the valve body 181 provided thereto.

The bar 182 is provided to an inside of the valve body 181, for reciprocating between the inside of the first tube 120 and the inside of the valve body 181 under the control of a control part (not shown).

The valve 190 blocks pass of the ball 190 as the bar 182 is projected across the inside of the first tube 120. Meanwhile, at the time the bar 182 is projected from the valve body 181, a fore end of the bar 182 blocks a part of an inside of the second tube 130 for blocking pass of the ball 190 between the second tube 130 and the inlet tube 110. Since such a valve structure facilitates pass of the washing water through the first tube 120 and the second tube 130 while blocking pass of the ball 190, movement of the ball 190 can be controlled, effectively.

In the meantime, the device for controlling a washing water passage of the present invention includes a sloped guide surface 125 connected between a top of the first tube 120 and a bottom of the first outlet tube 160, so that the ball 190, passed through the first tube 120 by the water pressure, makes an easy movement toward the first outlet tube 160.

Since the operation and a process of dish washing of the dish washer of the present invention is similar to the related art dish washer, description of the same will be omitted, except the device for controlling a washing water passage.

However, different from the related art dish washer, since the dish washer of the present invention can supply the washing water both toward the first arm 10 and the second arm 11, or only one of the first arm 10 and the second arm 11, a description related only to this will be given, below.

FIG. 3 illustrates an inside structure of a device for controlling a washing water flow passage when both of the first outlet tube 160 and the second outlet tube 170 are opened to spray the washing water both from the first arm 10 and the second arm 11.

In this instance, it is required that the bar 182 of the valve 180 is projected across the inside of the first tube 120 before the washing water is supplied by the pump 8. When the pump 8 is put into operation under a state the bar 182 is projected, the pumped washing water is introduced through the supply pipe 20 and the inlet tube 110. Though the ball 190 is pushed up by the water pressure once the washing water is introduced, but the ball 190 is caught at the bar 182 of the valve 180, and can not move to an upper side of the first tube 120.

Therefore, under the state shown in FIG. 3, one portion of the washing water introduced through the inlet tube 110 is discharged to the first outlet tube 160 via the first tube 120, and the other portion of the washing water is discharged to the second outlet tube 170 via the second tube 130 and the third tube 140. The washing water discharged through the first outlet tube 160 is supplied to the first arm 10 and washes the dishes on the upper rack 4 of the washing chamber 3, and the washing water discharged through the second outlet tube 170 is supplied to the second arm 11 and washes the dishes on the lower rack 5 of the washing chamber 3.

A state both the first and second tubes 160 and 170 are opened as shown in FIG. 3 is favorable for a case when there are many dishes to require placing the dishes both on the upper and lower racks 4 and 5.

Figure 4:
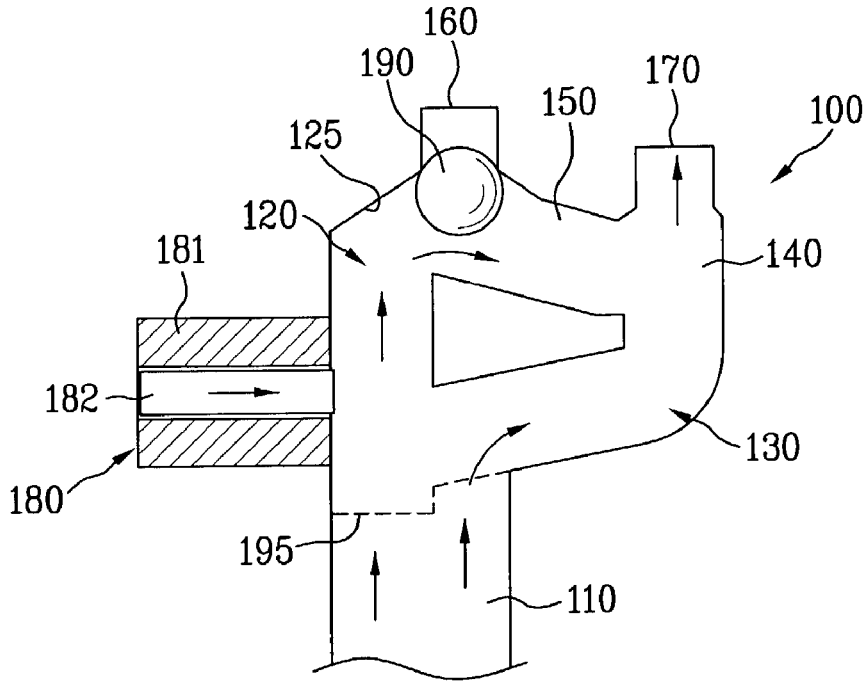
FIG. 4 illustrates a device for controlling a washing water flow passage of the present invention, showing positions of a ball and a bar when washing water is discharged to a second outlet tube.

FIG. 4 illustrates an inside structure of a device for controlling a washing water flow passage when the first outlet tube 160 is closed and the second outlet tube 170 is opened to spray the washing water only from the second arm 11.

As shown in FIG. 3, such a case is occurred when the bar 182 is pulled into the valve body 181 in a state the washing water is discharged through both the first outlet tube 160 and the second outlet tube 170. That is, the ball 190 has the water pressure continuously exerted thereon in an upper side direction of the first tube 120. If the bar 182 is pulled in, the ball 190 moves up quickly by the water pressure until the ball 190 is brought into close contact with the first outlet tube 160 when the guide surface 125 guides the ball 190. Since the ball 190 in close contact with the first outlet tube 160 has the water pressure continuously exerted thereon, the ball 190 keeps closing the first outlet tube 160 until the supply of the washing water stops. Thus, when the ball 190 closes the first outlet tube 160, all the washing water introduced through the inlet tube 110 is discharged through the second outlet tube 170. According to this, the washing water discharged through the second outlet tube 170 is sprayed from the second arm 11, to wash the dishes on the lower rack 5.

Therefore, a state illustrated in FIG. 4 is useful for a case when there are a small number of dishes to be washed, to intend to carry out the washing using the lower rack 5 only. Moreover, while the washing water can be saved, since an amount of the washing water sprayed only through the second arm 11 is less than an amount of the washing water sprayed both through the first arm 10 and the second arm 11, washing performance is improved since a spray pressure of the washing water increases.

Figure 5:
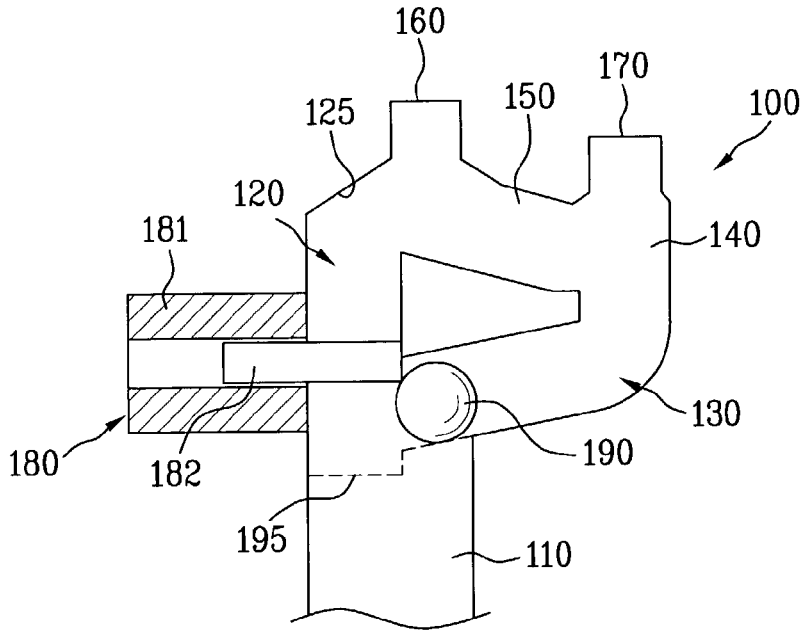
FIG. 5 illustrates a device for controlling a washing water flow passage in FIG. 4, showing positions of a ball and a bar when supply of washing water is stopped.

FIG. 5 illustrates a device for controlling a washing water flow passage in FIG. 4, showing positions of a ball and a bar when supply of washing water is stopped.

When the washing water is supplied in a state shown in FIG. 4, the ball 190 in close contact with the first outlet tube 160 falls down by gravity. In this instance, since the axis of the first outlet tube 160 passes the outside of the first tube 120, the ball 190 fallen from the first outlet tube 160, does not drop to a lower side of the first tube 120, but rolls down along the fourth tube 150. The ball 190, rolled down along the fourth tube 150, drops to a lowest end of the second tube 130 via the third tube 140. Since the bar 182 of the valve 180 is projected to block a part of the inside of the second tube 130, the ball 190 can not reach to the ball seat 195, but is held and stopped at the fore end of the bar 182. To do this, it is required to project the bar 182 of the valve 180 in a state of FIG. 4 in advance before supply of the washing water is stopped. When the washing water is supplied by putting the pump 8 into operation from a state of FIG. 5, a state of FIG. 6 is occurred.

Figure 6:
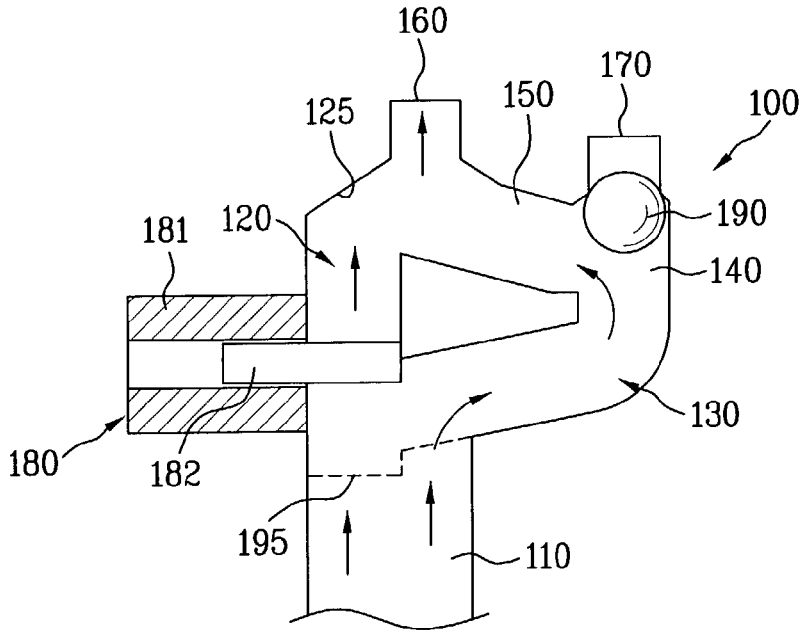
FIG. 6 illustrates a device for controlling a washing water flow passage of the present invention, showing positions of a ball and a bar when washing water is discharged to a first outlet tube.

FIG. 6 illustrates a device for controlling a washing water flow passage of the present invention, showing positions of a ball and a bar when washing water is discharged to a first outlet tube.

When the washing water is supplied in a state of FIG. 5, the ball 190 rises quickly and is brought into close contact with the second outlet tube 170. In this instance, since the fourth tube 150 and the third tube 140 are connected at a great angle, the ball 190 rising by the water pressure, does not move toward the fourth tube 150, but rises toward an upper side of the third tube 140, and is brought into close contact with the second outlet tube 170 formed on top of the third tube 140, thereby closing the second outlet tube 170, to cause the washing water introduced through the inlet tube 110 to be discharged through the first outlet tube 160. Accordingly, in the case of FIG. 6, the washing water is sprayed only from the first arm 10, to wash the dishes on the upper rack 4.

This case is very favorable in a case an amount of the dishes to be washed is small to wash the dishes by using the upper rack 4 only. Of course, in this case too, the consumption of the washing water is saved, and the washing performance is also improved since the water pressure of the washing water sprayed from the first arm 10 becomes higher.

It is preferable that the ball 160 is formed of rubber, only on a surface thereof, or entirely for preventing leakage, because the ball 190 is brought into close contact with, and closes, the first outlet tube 160 or the second outlet tube 170.

The present invention has the following advantages.

First, the washing only by using the upper rack or the lower rack of the dish washer permits to reduce a washing water consumption and very favorable for a washing with a small amount of dishes.

Second, the high spray pressure from the arm in the case the washing is carried out only using either the upper rack or the lower rack of the dish washer improves a washing performance.

Third, the simple structure of the device for controlling a washing water passage permits easy fabrication and easy mounting on the dish washer.

It will be apparent to those skilled in the art that various modifications and variations can be made in the present invention without departing from the spirit or scope of the invention.

For an example, the ball 190 may be formed of a plastic, and lower parts of the first outlet tube 160 and the second outlet tube 170 are formed of rubber or the like.

Thus, it is intended that the present invention cover the modifications and variations of this invention provided they come within the scope of the appended claims and their equivalents.

What is claimed is:

1. A dish washer comprising:

a cabinet having a door in one side thereof;

a washing chamber provided to an inside of the cabinet;

a water supplier that supplies, filters and pumps washing water supplied from an outside of the cabinet;

a piping that guides the washing water pumped by the water supplier to supply washing water to the washing chamber;

a plurality of arms that spray the washing water supplied into the washing chamber by guidance of the piping to wash the dishes; and a controller that controls a washing water flow passage in the middle of the piping control a flow passage of the washing water with a ball moving by water pressure and gravity, to supply the washing water to at least one of the arms, wherein the piping comprises:

a supply pipe that receives the washing water pumped at the water supplier that supplies the washing water, and branch pipes branched from the supply pipe to the arms, wherein the controller is provided to a portion where the supply pipe and the branch pipes join, and wherein the controller that controls a washing water flow passage comprises:

an inlet tube connected to the supply pipe, a first tube extended upward from the inlet tube, a second tube extended slanted upward from the inlet tube, a third tube extended upward from a top of the second tube, a fourth tube connected between the first tube and the third tube in a downward slanted direction, a first outlet tube formed on a top of a portion where the first tube and the fourth tube join, and connected to one of the branch pipes, a second outlet tube formed on a top of the third tube, and in communication with a second arm connected to the other one of the branch pipes, a ball configured to move in the first, second, third, or fourth tube by a washing water pressure and gravity, and open/close the first or second outlet tube selectively;

a ball seat provided to an inside of the inlet tube to seat the ball, and a valve provided to one side of the first tube to selectively block passage of the ball.

2. The dish washer as claimed in claim 1, wherein the water supplier comprises:

a cleaning filter that filters the washing water supplied to the cabinet, a sump that stores the washing water filtered at the cleaning filter, and a pump that pumps the washing water from the sump.

3. The dish washer as claimed in claim 1, wherein the ball seat is formed of a net.

4. The dish washer as claimed in claim 1, wherein the ball seat is a projection from an inside surface of the inlet tube.

5. The dish washer as claimed in claim 1, wherein the ball is formed of rubber, only a surface thereof, or entirely.

6. The dish washer as claimed in claim 1, wherein the first and second outlet tube have a diameter smaller than a diameter of the ball.

7. The dish washer as claimed in claim 1, wherein the first outlet tube has an axis passing through an outside of the first tube.

8. The dish washer as claimed in claim 1, wherein the valve includes:

a valve body provided to an outside surface of the first tube having an inside thereof in communication with an inside of the first tube, and a bar provided to an inside of the valve body for being projected across the inside of the first tube to block passage of the ball.

9. The dish washer as claimed in claim 8, wherein the bar comprises a fore end that blocks a part of an inside of the second tube to block passage of the ball between the second tube and the inlet tube when the bar is projected from the valve body.

10. A dish washer comprising:

a cabinet having a door in one side thereof;

a washing chamber provided to an inside of the cabinet;

a water supplier that supplies, filters and pumps washing water supplied from an outside of the cabinet;

a piping that guides washing water pumped by the water supplier supply washing water to the washing chamber;

a plurality of arms that spray the washing water supplied into the washing chamber by guidance of the piping to wash dishes; and a controller that controls a washing water flow passage in the middle of the piping to control a flow passage of the washing water with a ball moving by water pressure and gravity, to supply the washing water to at least one of the arms, wherein the controller that controls a washing water flow passage comprises:

an inlet tube to which pumped water is introduced;

first and second outlet tubes respectively communicating with the inlet tube and at least one of the arms;

the ball configured to move between the inlet tube, and the first and second outlet tubes by water pressure and gravity to open/close the first and second outlet tubes selectively or open the first and second outlet tubes at the same time; and a valve provided between the inlet tube and the first or second outlet tube to selectively block passage of the ball between the inlet tube and the second outlet tube as well as the first outlet tube, the valve allowing pumped water in the inlet tube to proceed toward the first or second outlet tube.

11. The dish washer as claimed in claim 10, wherein the controller that controls a washing water flow passage further includes a ball seat provided in the inlet tube to seat the ball, the seat allowing pumped water in the inlet tube to proceed toward the first or second outlet tube.

12. A dish washer comprising:

a cabinet having a washing chamber provided therein;

a pump provided in the cabinet;

a plurality of arms provided in the washing chamber to spray pumped water into the washing chamber; and a controller that controls a washing water flow passage provided between the pump and the arms, wherein the controller comprises:

an inlet tube to which pumped water is introduced;

first and second outlet tubes respectively communicating with the inlet tube and at least one of the arms;

a ball configured to move between the inlet tube and the first and second outlet tubes by water pressure and gravity to close the first or second outlet tube selectively or open the first and second outlet tubes at the same time; and a valve provided between the inlet tube and the first or second outlet tube to selectively block passage of the ball between the inlet tube and the second outlet tube as well as the outlet tube, the valve allowing water in the inlet tube to proceed toward the first or outlet tube.

* * * * *

UNITED STATES PATENT AND TRADEMARK OFFICE

CERTIFICATE OF CORRECTION

PATENT NO. : 7,237,563 B2
APPLICATION NO. : 10/406196
DATED : July 3, 2007
INVENTOR(S) : Dae Yeong Han It is certified that error appears in the above-identified patent and that said Letters Patent is hereby corrected as shown below:

At column 8, lines 49 and 50 of the printed patent, “to wash the dishes” should be --to wash dishes--

At column 9, line 13 of the printed patent, “a ball configured to move” should be --the ball configured to move--

At column 9, line 15 of the printed patent, “and open/close the first or second” should be --and to open/close the first and second--

At column 9, lines 34 and 35 of the printed patent, “wherein the first and second outlet tube” should be --wherein the first and second outlet tubes--

At column 9, line 41 of the printed patent, “wherein the valve includes” should be --wherein the valve comprises--

At column 10, lines 1 and 2 of the printed patent, “pumped by the water supplier supply” should be --pumped by the water supplier to supply--

At column 10, line 53-54 of the printed patent, “as well as the outlet tube, the valve allowing water in the inlet tube to proceed toward the first or outlet tube” should be --as well as the first outlet tube, the valve allowing pumped water in the inlet tube to proceed toward the first or second outlet tube--

Signed and Sealed this

Twenty-fourth Day of June, 2008

JON W. DUDAS
*Director of the United States Patent and Trademark Office*